US008696525B2

(12) United States Patent
Solanyk et al.

(10) Patent No.: US 8,696,525 B2
(45) Date of Patent: Apr. 15, 2014

(54) TRACK START BLOCK FOR SWIMMING

(75) Inventors: Eric Solanyk, Loveland, CO (US); Christian Stockinger, Loveland, CO (US)

(73) Assignee: Colorado Time Systems, Loveland, CO (US)

( * ) Notice: Subject to any disclaimer, the term of this patent is extended or adjusted under 35 U.S.C. 154(b) by 314 days.

(21) Appl. No.: 13/275,479

(22) Filed: Oct. 18, 2011

(65) Prior Publication Data

US 2013/0095980 A1 Apr. 18, 2013

(51) Int. Cl.

| | |
|---|---|
| ***D06N 7/04*** | (2006.01) |
| ***E04H 4/00*** | (2006.01) |
| ***H01R 33/955*** | (2006.01) |
| ***A63B 31/00*** | (2006.01) |

(52) U.S. Cl.
USPC ..... 482/55

(58) Field of Classification Search
USPC ..... 292/288, 343; 482/14–15, 19, 23, 26, 482/30, 92, 111, 142, 55, 56, 148, 107; 4/494, 496
See application file for complete search history.

(56) References Cited

U.S. PATENT DOCUMENTS

| | | | | | |
|---|---|---|---|---|---|
| 804,585 | A | * | 11/1905 | Depue | 292/343 |
| 3,010,321 | A | * | 11/1961 | Morrow | 73/379.05 |
| D202,546 | S | * | 10/1965 | French | D21/802 |
| D240,811 | S | * | 8/1976 | Beall | D21/802 |
| 5,916,031 | A | | 6/1999 | Casillan | |
| D464,699 | S | * | 10/2002 | Brice | D21/802 |
| 6,523,188 | B1 | * | 2/2003 | Kiefer et al. | 4/496 |
| 7,193,167 | B1 | * | 3/2007 | Brice | 200/52 R |
| 2005/0227813 | A1 | * | 10/2005 | Curry | 482/30 |

FOREIGN PATENT DOCUMENTS

| | | | |
|---|---|---|---|
| DE | 2358876 | A1 | 2/1975 |
| DE | 2517738 | A1 | 11/1976 |

* cited by examiner

*Primary Examiner* — Oren Ginsberg
*Assistant Examiner* — Rae Fischer
(74) *Attorney, Agent, or Firm* — McAndrews, Held & Malloy, Ltd.

(57) ABSTRACT

A starting block for swimming equipped with a single curved surface to facilitate track starts while reducing the trip hazard of such a surface. This allows for safer mounting from rear and side steps and removes undesirable gaps in the top surface of the starting block. A pliable embodiment of said curved surface can modify the distance of the curvature from the leading edge of the starting block to adapt to different swimmer needs. An apparatus to obtain said distance for a given swimmer from a meet management system to modify the pliable embodiment for quick change during time-constrained events such as meets.

2 Claims, 5 Drawing Sheets

TRACK START BLOCK FOR SWIMMING

REFERENCES CITED

| | | |
|---|---|---|
| DE2358876 | February 1975 | Gajic |
| DE2517738 | November 1976 | Newestin |
| U.S. Pat. No. 5,619,031 | June 1999 | Casillan |
| US2005/0227813 | October 2005 | Curry |

FIELD OF THE INVENTION

The present invention is in the field of starting blocks for swimmers in competitive swimming and training.

BACKGROUND OF THE INVENTION

In competitive swimming, the rules allow for the athlete to start a race from outside the water from a starting block, which allows for a faster start than from within the water. A starting block is a platform adjacent to the pool, positioned in the center axis of a pool lane, on which a swimmer can stand and jump off. The size, height of the front edge above the water, angle of the platform relative to horizontal and other defining parameters of the platform are specified in the various rule books for swimming.

There are several types of start for a swimmer from the block. One is to have both feet at the leading edge of the block. Another is to have one foot at the leading edge, the other one further back. This start type is called "track start".

In a track start the swimmer has the toes of the front foot curled around the leading edge and the back foot is set on the starting platform behind the front foot. The starting platform may be inclined to a maximum of 10 degrees to horizontal, as the ruling books state. Therefore most of the horizontal jump force of the back foot, which is desirable for a fast start, is created through friction of the back foot with the starting platform. Although starting platforms are equipped with a surface with a high coefficient of friction, it is desirable to increase said horizontal force by increasing the angle of the surface the back foot touches. The rule books provide for that.

In recent years an invention to improve track starts, described in US patent application US2005/0227813 and international patents such as EP1501609B1, inventor Curry, Francesca, has led to the adding of a second surface to the starting platform in current embodiments of starting blocks.

In a track start, this second surface increases the angle for the back foot by being upwardly inclined with respect to the platform for the swimmer to push against with the backwards foot whilst jumping off from the platform.

The embodiments of said invention place a "foot wedge" such as 5 shown in FIG. 1 at the rear end of the starting block. The distance of this foot wedge from the leading edge is adjustable to support different body sizes and preferences of swimmers.

This adjustability leads to a profile of possible top surfaces 4 in FIG. 1 that a starting block may have as sanctioned by the rule books. In the further description we call this the "sanctioned profile".

There are several problems with such embodiments, some of them are listed below:

- The foot wedge creates a trip hazard on the top of the starting block, especially for swimmers mounting from a step at the rear. The trip hazard is also present with a step to mount from any side when the wedge is set in a fairly forward position.
- In many pools, particularly smaller ones with narrower lanes, the space on the sides is constrained and it is desirable to utilize steps on the back of the block but the trip hazard posed by the foot wedge interferes with this.
- In embodiments with a moveable wedge the gap between the wedge and the top of the starting block is not desirable, as it does not support the swimmer's foot in that area.

The current invention targets to improve one or more of said problems.

BRIEF SUMMARY OF THE INVENTION

Since the use of a second surface for the back foot is problematic as described above, the present invention utilizes one single continuous surface to present, within the constraints of the sanctioned block profile, a surface with continually increasing angles relative to the horizontal level.

As shown in FIG. 3A, one embodiment of the invention fits its curvature within the sanctioned profile 4.

Since the biomechanics of each swimmer are different every swimmer will like a different angle of the surface to place the back foot on for a personally optimal start. Through putting the back foot closer or farther away from the leading edge of the curved surface, different angles will be encountered by said back foot. The optimum angle of a given swimmer will be found experimentally during training and can change over time.

Since the block top presents only one surface to the swimmer, the trip hazard is reduced and back mounting steps can be utilized. This embodiment of the invention also eliminates the undesirable gap between a moveable wedge and the block surface.

Since the embodiments of the invention so far described are theoretically optimal for only one body size of swimmers; a further refinement is described. In this embodiment the surface of the starting block is pliable and a forming block underneath said pliable surface forms an upwardly curved surface on the starting platform as before. This forming block can be moved closer and further away from the leading edge, within the constraints of the sanctioned profile. Thus it creates the optimum conditions for the back foot of the swimmer starting with a track start. The forming block is solidly set in place once the desired distance is adjusted so that the forming block does not move during the start should the swimmer exude considerable start forces on the block.

The back side of the forming block, starting at the top, is curved downwards to create a smooth surface with the pliable surface 20 to reduce trip hazards.

The optimal distance of the forming block for a given swimmer is something which is experimentally found during training and can change over time. It is desirable that this distance can be set up quickly and easily during a meet, where typically very little time is available between races or legs of a relay race.

To conducting a competitive swimming event another necessary function is what is called meet management. It includes gathering, tracking and organizing data about each athlete such as name, gender, age, team and others. In addition, a significant function of meet management is determining and tracking specific events, heats and lanes for each swimmer. Meet management is typically administered in information technology systems.

The setting distance of a forming block or a foot wedge can be one of the data points known to the meet management about a particular swimmer. This setting can be transmitted to the starting block for a given race to set the distance before the swimmer mounts the block by manual or motorized means such as stepper motors, hydraulics, pneumatics or other means. Thus a fast adaption of individual settings can be realized needing little set up time between swimmers.

DETAILED DESCRIPTION OF THE INVENTION

Figure 1:
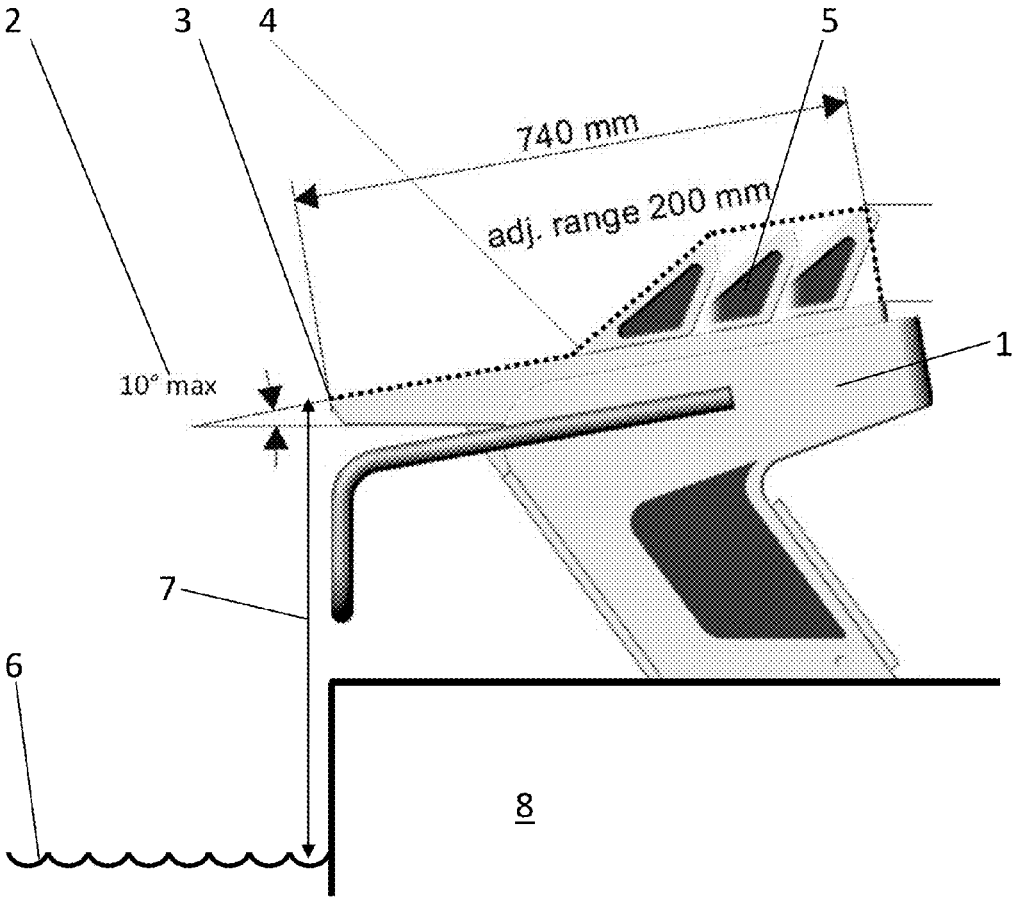
FIG. 1 PRIOR ART
FIG. 1 is a side view of a starting block on a pool deck.

In FIG. 1 an embodiment of a starting block 1 of known prior art mounted on the pool deck 8 is shown. The angle 2 of the block surface is limited by the swim rules to the shown maximum of 10 degrees. The leading edge 3 of the block is parallel to the pool edge, perpendicular to the drawing surface. 4 is the maximum profile of a starting block top sanctioned by ruling bodies (sanctioned profile). 5 is a foot wedge with an adjustment range of 200 mm. The adjustability is symbolized by three foot wedges drawn overlapping each other. The leading edge 3 is situated in the distance range 7, which is described in the ruling books over the water level 6 (50 to 75 cm as of the year 2011).

Figure 2:
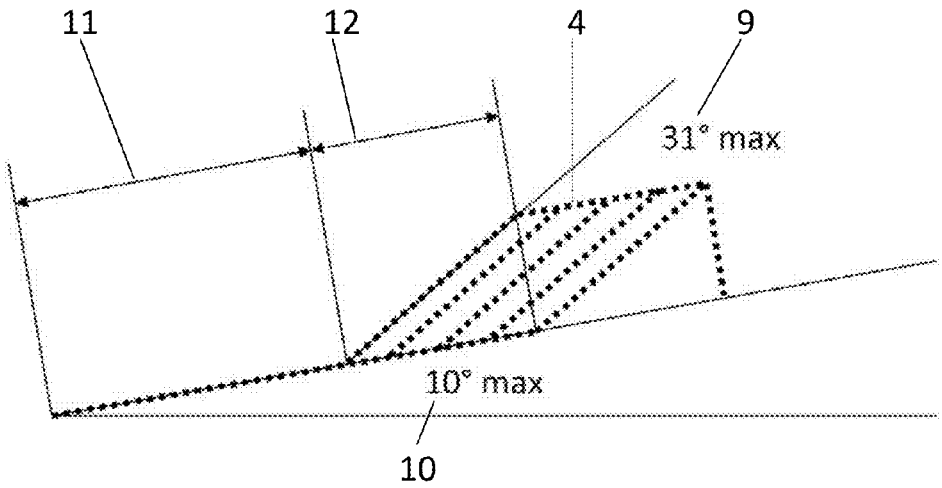
FIG. 2 is a diagram of the sanctioned starting block profile.

FIG. 2 shows an example of five different settings of the foot wedge creating the sanctioned profile 4. The maximum allowed angle 10 for the front part of the starting block surface and the maximum allowed angle 9 for the track start surface are shown. The distances 11 and 12 are sanctioned in the rule books with 340 mm and 200 mm respectively as of the year 2011.

Figure 3A:
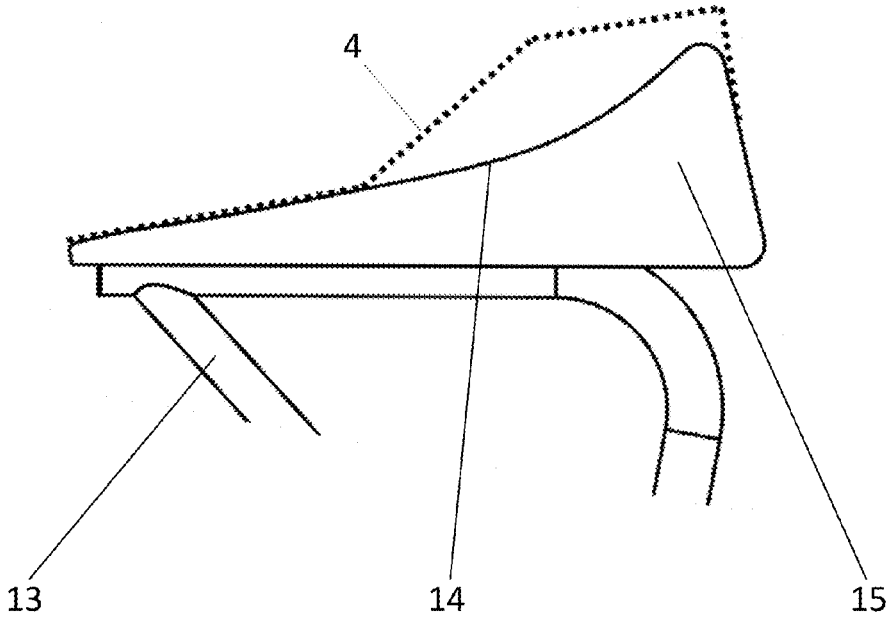
FIG. 3A is a diagram showing the superposition of the sanctioned profile on a curved starting block profile.

FIG. 3A shows an embodiment of a curved starting block surface fit into the sanctioned profile 4. The curved surface 14 needs to not exceed the sanctioned profile 4 and provides a plurality of angles for the back foot of the swimmer. The curved top 15 is mounted on the carrier structure 13 of the starting block.

Figure 3B:
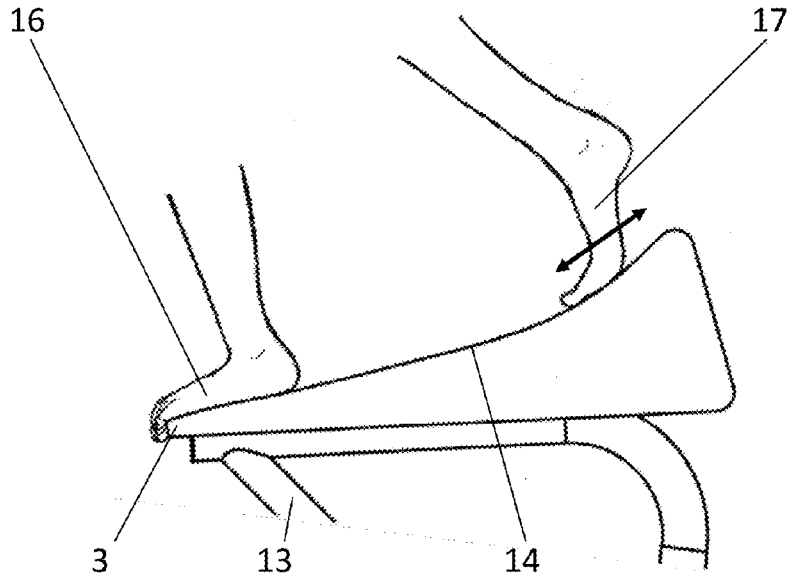
FIG. 3B is a side view of a curved profile with two feet and lower legs of a swimmer.

FIG. 3B shows the feet of a swimmer on a curved surface 14. The toes of the front foot 16 are curled around the leading edge 3 of the starting block. The back foot 17 is offered a variety of angles depending on how far back from the leading edge 3 it is placed, as indicated by the double arrow. Thus the swimmer can assume the personally optimum start position and exude optimum horizontal force at the jump from the starting block.

Figure 3C:
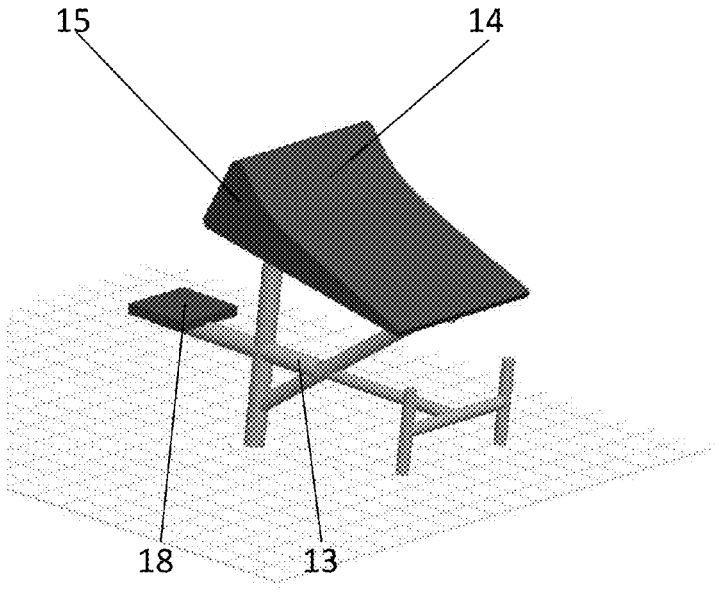
FIG. 3C is a perspective view of a starting block with curved surface and back step.

As shown in FIG. 3C this embodiment of a curved starting block surface 14 of a curved top 15 mounted on a carrier structure 13 can be equipped with a rear step 18 without creating a trip hazard. A step from either side of the starting block can also be utilized.

Figure 4A:
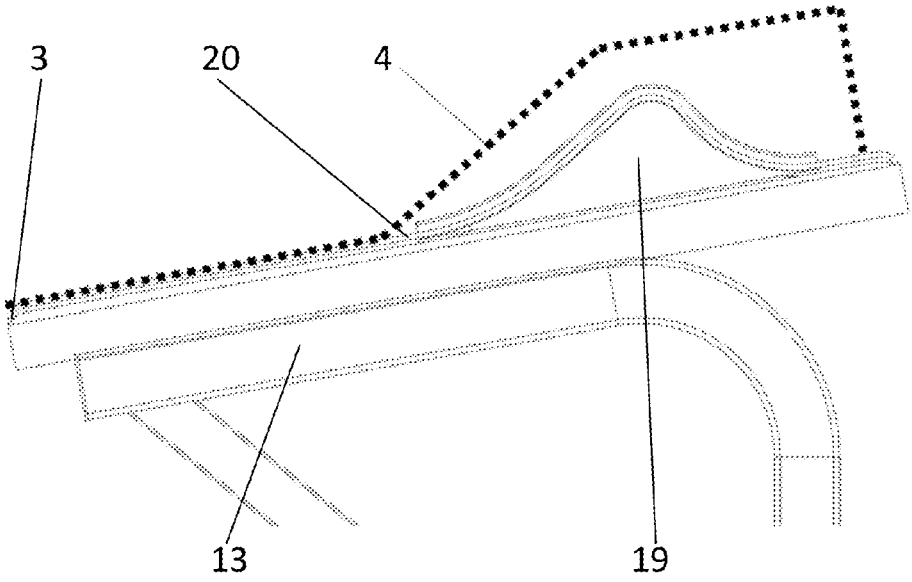
FIG. 4A is a diagram showing the superposition of the sanctioned profile on a pliable starting block profile in side view.
Figure 4B:
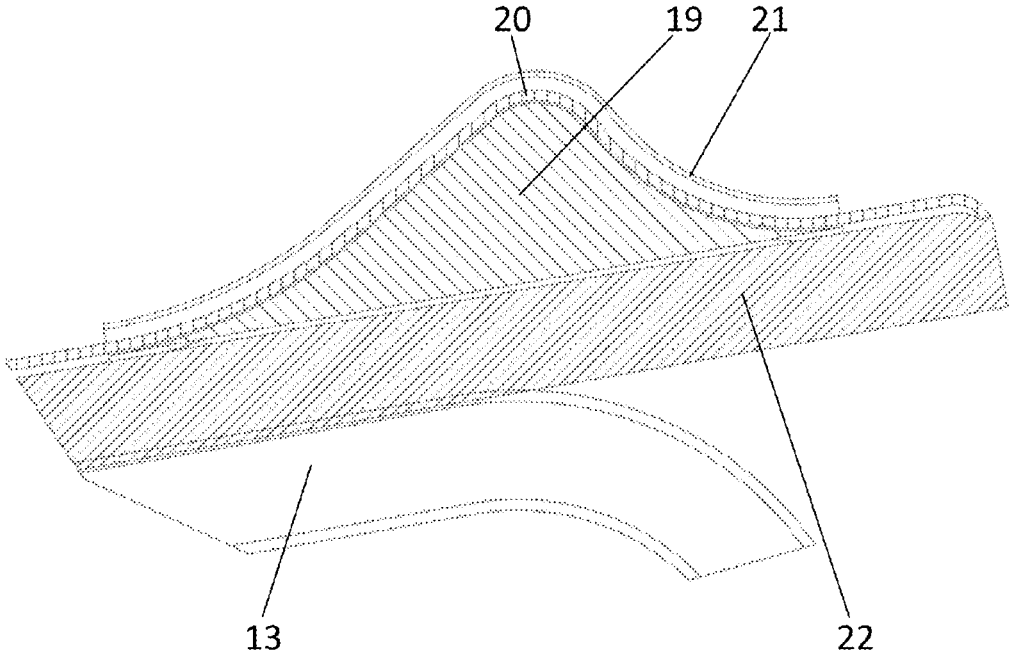
FIG. 4B is a detail of the side view of a pliable starting block profile.

FIGS. 4A and 4B show the fit of a starting block with a pliable surface 20 into the sanctioned profile 4. The forming block 19 forms the pliable surface 20 through its form and for example side rails 21 into the desired curved profile. The forces from the swimmer, which are transmitted through the pliable surface 20 into the forming block 19 are led into the carrier plate 22 which is mounted on the carrier structure 13 of the starting block.

Figure 4C:
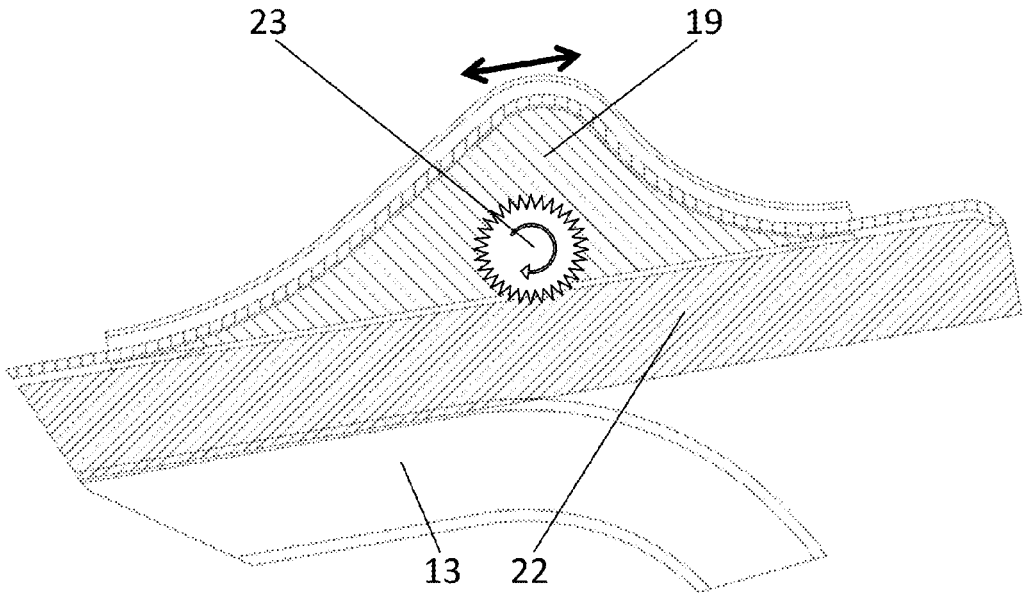
FIG. 4C is a detail of the side view of a pliable starting block profile with means to adjust the distance of the forming block from the leading edge.

The forming block 19 in FIG. 4C has means to be moved closer and further away from the leading edge 3. One embodiment is a gear wheel 23, which can be turned clockwise or counterclockwise. It is attached with an axle to the forming block 19. It locks into the carrier plate 22 and through turning can set the forming block 19 at the desired distance from the leading edge 3.

The gear wheel 23 can be turned manually, for example with a hand wheel, or mechanically through for example a motor. If it is turned by a motor or other means, the information how much to turn it, which determines the distance of the forming block 19 from the leading edge 3 for a given swimmer, can be obtained through means such as a data cable or wireless transmission from either a manual input device or an IT system of a meet manager.

This enables fast set up during races for the series of swimmers utilizing one and the same starting block in sequence as the meet progresses. As an example, the first swimmer could have the distance set to 350 mm, the second to 400 mm, the third to 540 mm, the fourth to 380 mm and so forth. As the meet management calls out a given swimmer for his or her start, the related information of each swimmer's preferred starting block forming block distance is transmitted to the starting block and the distance is set. Once the start of the given swimmer has occurred, the starting block forming block distance for the next swimmer can be transmitted and the distance set, and so forth.

Figure 4D:
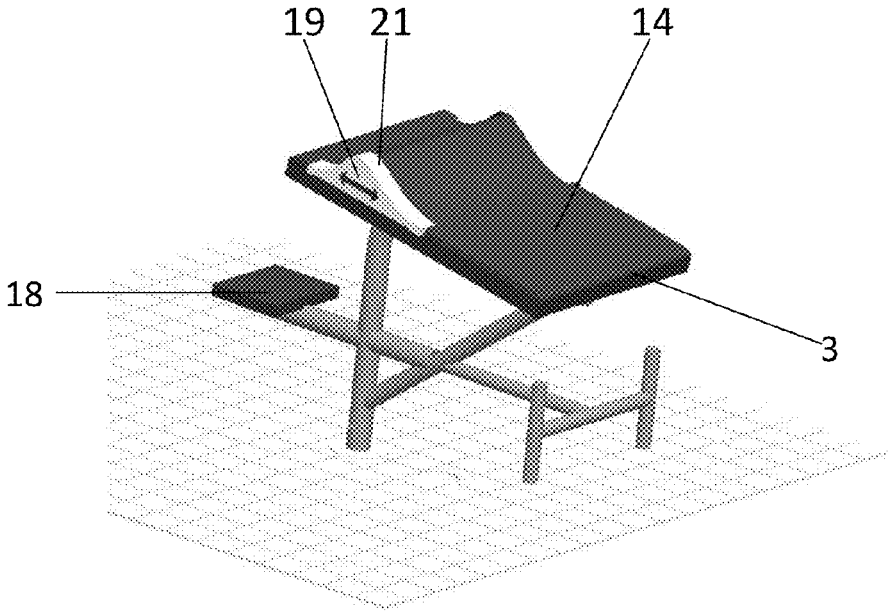
FIG. 4D is a perspective view of a starting block with pliable profile.

FIG. 4D shows a perspective view of the pliable surface starting block with a rear step 18. The distance from the forming block 19 to the leading edge 3 can be set. The side rails 21 together with the forming block 19 form the pliable surface 20 into the desired curved profile 14.

The disclosed embodiments are representative of presently preferred forms of the invention, but are intended to be illustrative rather than definitive of the invention.

The invention claimed is:

1. A swimming starting block assembly comprising:

a starting block having a top surface and a leading edge that is nearest the water when installed at a swimming facility;

a generally vertical member for fixing a bottom surface of the starting block to a pool deck;

a pliable surface member suitable for mounting on the starting block; and a forming block shaped to impart a progressive-curve profile with a plurality of tangential angles relative to the top surface, wherein the forming block is deployed on the top surface of the starting block and beneath the pliable surface member, and wherein the pliable surface member is configured to assume the contours created by the starting block and the forming block when installed.

2. The swimming starting block assembly of claim 1, wherein the position of the forming block is adjustable along a trajectory that is non-parallel to the leading edge.

* * * * *